US005125252A

United States Patent [19]

Ayres et al.

[11] Patent Number: 5,125,252

[45] Date of Patent: Jun. 30, 1992

[54] VARIABLE GEOMETRY TUBE BENDING DIES

[75] Inventors: Paul S. Ayres, Forest, Va.; Richard L. Holbrook, Louisville; Dwight L. Turner, North Canton, both of Ohio

[73] Assignee: The Babcock & Wilcox Company, New Orleans, La.

[21] Appl. No.: 495,556

[22] Filed: Mar. 19, 1990

[51] Int. Cl.[5] ..... B21D 7/00

[52] U.S. Cl. ..... 72/157; 72/389; 72/413; 72/478

[58] Field of Search ..... 72/157, 159, 369, 389, 72/413, 473, 459, 478, 481, 482

[56] References Cited

U.S. PATENT DOCUMENTS

| | | | |
|---|---|---|---|
| 339,804 | 4/1886 | Norwood | 72/413 |
| 1,412,730 | 4/1922 | Winters | 72/481 X |
| 1,773,430 | 8/1930 | McConnell | 72/157 |
| 1,849,181 | 3/1932 | Francis | 72/157 |
| 2,365,482 | 12/1944 | Manken et al. | 72/478 X |
| 2,966,934 | 1/1961 | Huet | 72/413 X |
| 3,276,236 | 10/1966 | McDowell | 72/157 |

FOREIGN PATENT DOCUMENTS

| | | | |
|---|---|---|---|
| 58-192620 | 11/1983 | Japan | 72/389 |
| 62-279030 | 12/1987 | Japan | 72/473 |

*Primary Examiner*—Lowell A. Larson
*Assistant Examiner*—Michael J. McKeon
*Attorney, Agent, or Firm*—Vytas R. Matas; Robert J. Edwards; Daniel S. Kalka

[57] ABSTRACT

An improved variable geometry tooling die is disclosed employing die segments 12 for use in die-press bending of materials. A forming die 10 is constructed of a plurality of segmented portions 12 which are radially adjustable for bends of different radii. Interchangeable inserts 20 in the segmented dies 12 allows for bending materials with various outside diameters and shapes.

9 Claims, 6 Drawing Sheets

FIG. 4
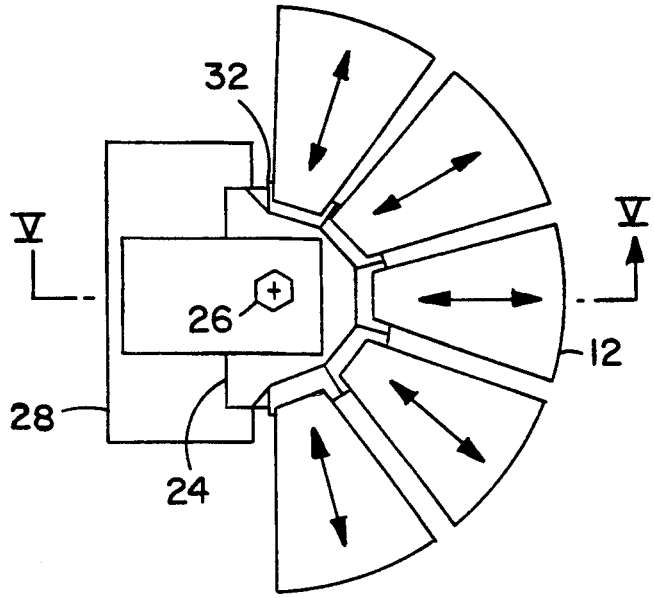
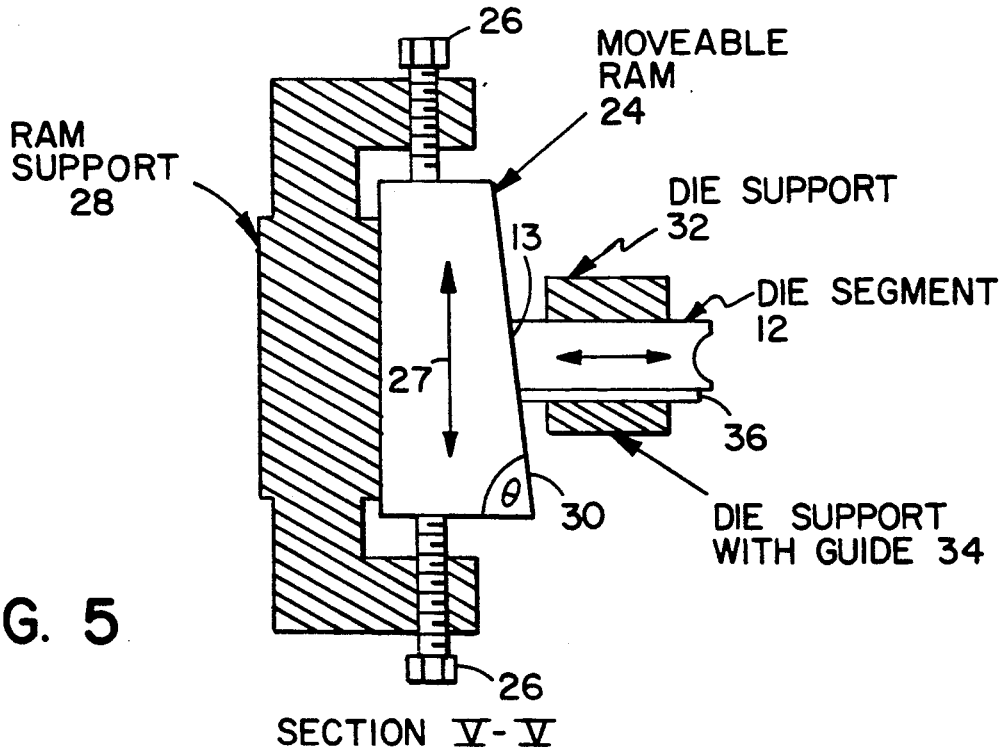
FIG. 5

VARIABLE GEOMETRY TUBE BENDING DIES

BACKGROUND OF THE INVENTION

The present invention relates to tube bending and, more particularly, to variable geometry tooling employing segmented dies to effect this bending.

Numerous bending methods have been developed over the years, but generally speaking, most are variations of a few basic processes. The die-press method, wherein the tube is laid across a plurality of supporting dies and then subjected to the pressure exerted by a movable forming die, is useful to form bend angles up to about 120°. The foil method of bending usually employs three triangularly arranged rolls, the center one of which is adjustable. The workpiece is fed between the outer fixed driven rolls and the adjustable roll to form bends up to 360°. The compression method utilizes a stationary bending die and a movable pressure die. The pressure die traverses the periphery of the bending die, wiping the workpiece into a groove of the bending die to form bends with angles up to 180°. Rotary draw bending is similar to compression bending except the bending die rotates and the pressure die is either stationary or movable.

Currently, rotary draw bending machines form the bends in much of the 1 to 3 inch tubing used in high pressure steam boilers for the electric power generating industry. These machines use a range of dies depending on the outside diameter of the tube and the radius of the bend required. These machines make one bend at a time and the workpiece must be sequentially re-positioned accurately for multiple bends which are made for example in a S-shape. Frequently, such bends must be individually inspected and slightly adjusted to the correct geometry in an additional "check-and-set" operation. As a result, this method is both time and labor consuming.

In comparison, for multiple bends, die-press forming is three to four times faster than rotary draw bending because all forming is done in one die-press stroke. Because of the fixed nature and precision of the supporting dies, no subsequent check-and-set is normally required. However, a different set of dies is required for each tube diameter and bend configuration. This results in a large inventory of dies typically costing from $3,000 to $7,000 and taking from four to six weeks to obtain. The less efficient rotary draw benders are still used because of the many different bends required in different boiler designs. It is cost prohibitive to have a die available for every possible bend configuration.

Thus there is a need in the power generating industry for a cost effective tube bending apparatus and method which is accurate and time efficient.

SUMMARY OF THE INVENTION

The present invention solves the aforementioned problems by providing a variable geometry die for die-press bending formable materials such as tubing. The die is composed of a plurality of segmented portions or sectors situated in a semi-circular orientation which are radially movable to provide a continuous range of bend radii in a die-press bender for forming workpieces. The segmented portions are substantially triangular or pie-shaped with a curved base. In the preferred embodiment of the present invention, there are interchangeable inserts attached to the base of the segments to accommodate the bending of tubes of various outside diameters.

Accordingly, one object of the present invention is directed to providing a variable geometry die for use in a die-press bender.

Another object is directed to a method for continuously or incrementally varying the geometry of a die for use in a die-press bender in bending a material.

The various features of novelty which characterize the invention are pointed out with particularity in the claims annexed to and forming a part of this specification. For a better understanding of the invention, its operating advantages and specific objects obtained by its use, reference should be made to the accompanying drawings and descriptive matter in which a preferred embodiment of the invention is illustrated and described.

BRIEF DESCRIPTION OF THE DRAWINGS

In the drawings:

FIG. 4 is a schematic plan view of a mechanical arrangement for continuously varying the ram die radius;

FIG. 5 is a cross-sectional view of FIG. 4 taken along lines V—V;

DESCRIPTION OF THE PREFERRED EMBODIMENT OF THE INVENTION

Figure 1:
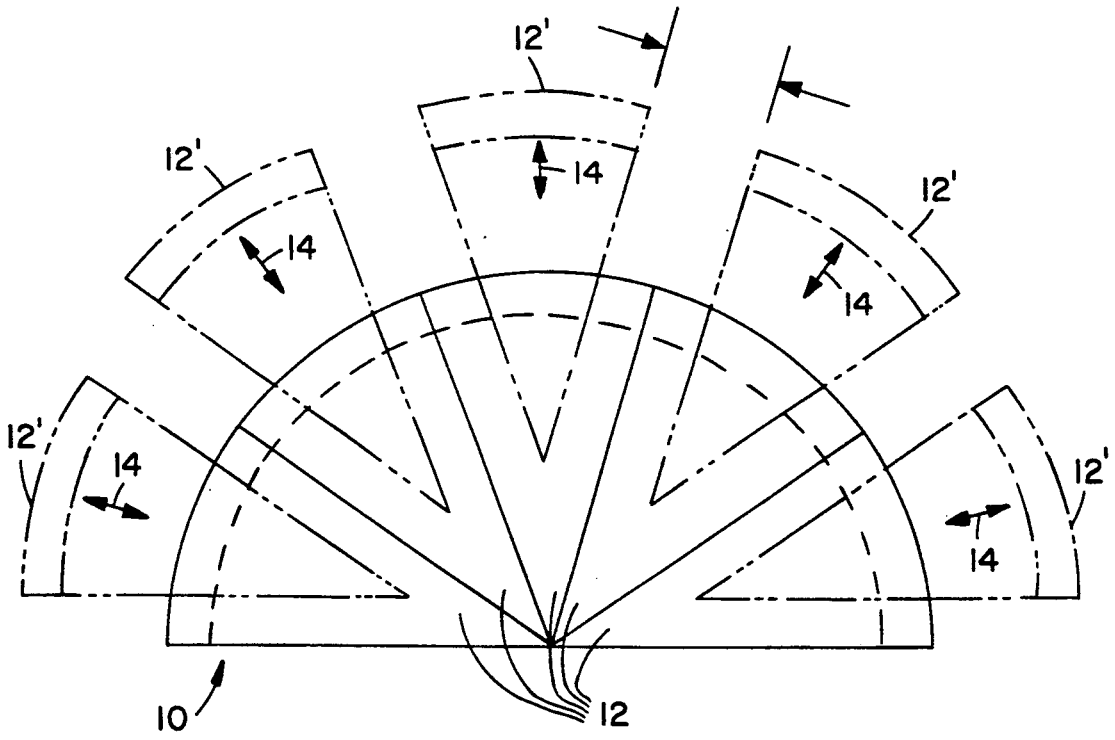
FIG. 1 is a partial schematic plan view of a variable geometry tube bending die in retracted and expanded positions.
Figure 10:
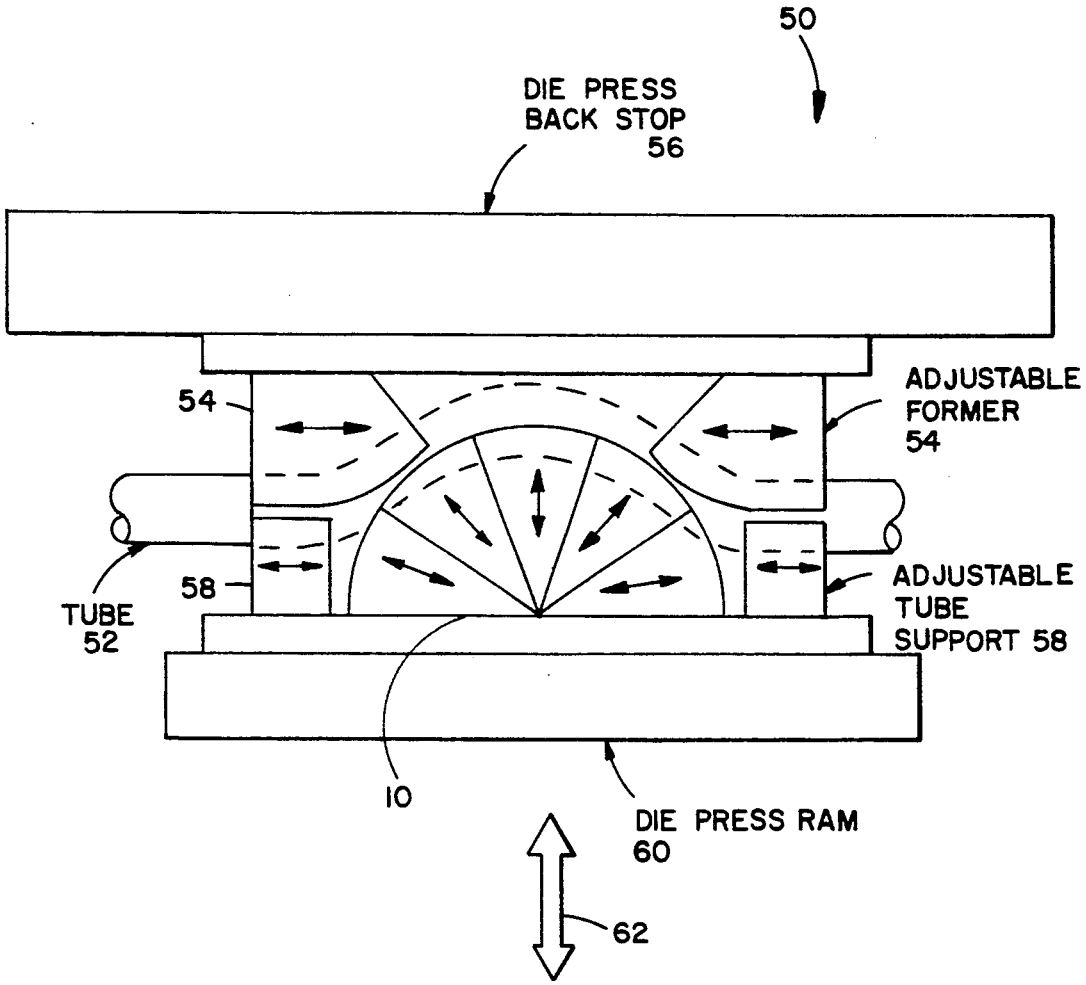
FIG. 10 is a partial sectional view of a general schematic arrangement of the present invention employed in a die-press bender.

The present invention resides in improved tooling in the form of dies for bending flowable (ductile) materials into a permanent configuration. Referring to FIG. 1, a segmented die 10 for use in die-press bending of tubing is shown in retracted 12 and expanded 12' positions. The die segments 12, 12' are intended for use in horizontal die-press benders, such as is illustrated in FIG. 10. This type of die-press bender is well known in the art, for example, a Nordberg die-press bender exerts a load between 70 and 115 tons when bending 2.5 inch OD Tube with a 0.25 inch wall thickness. This particular device is capable of a hydraulic pressure of 5,000 psi when the die is "bottomed out" which equates to a ram force load of about 200 tons. The die segments 12, in the retracted position, are shown as five in number although a greater or lesser number can be employed. The die segments 12 are radially movable as indicated by arrows 14 to an expanded position with the die segments 12' representing the die segments when moved to provide a continuous range of bend radii of tubing between the fully retracted and fully expanded positions.

It should be understood that although the invention is described as applicable to tubing, it is not so limited and can be applied to other shapes such as solid rods.

Die segments 12 show an expanded position 12' as indicated by dot-dash lines in FIG. 1 with the die segments 12' producing a gap 16 between each of the segments 12'. The gap 16 is defined by the following formula:

$$G=2D \sin (180/2N)$$

where:

G = gap distance in inches

D = radial expansion of the die 10 in inches

N = number of segments in 180°

When the die segments 12' are in the extended position, the gaps 16 between the segments 12' may cause tube buckling if thin wall tubing is being bent. It has been experimentally determined that 2.5 inch outside diameter carbon steel tubes such as ASTM A210 A1 with wall thicknesses greater than 0.200 inch can be successfully bent to any radius between 4 and 6 inches in a single segmented die 10 without buckling and without any support system within the tubing. No significant buckling occurred in these tubes even when the gap distance 16 is as great as 1.236 inches. Table 1 gives test results for bending 2.5 inch OD tubing of various thicknesses and bending radii. It is noted that good results were obtained for all bending radii with tube thickness greater than 0.200 inch and segment gaps up to 1.236 inches.

TABLE 1

| Tube MK | Bending Radius (In.) | Segment Gap (In.) | Wall Thickness, W (In.) | W/D | Maximum Hydraulic Pressure (Psi) | Maximum Ram Force (Tons) | Results |
|---|---|---|---|---|---|---|---|
| 1 | 4.0 | 0 | 0.109 | 0.044 | 2,000 | 78 | Collapsed |
| 2 | 4.0 | 0 | 0.150 | 0.060 | 2,300 | 90 | Collapsed |
| 3 | 4.0 | 0 | 0.203 | 0.081 | 2,700 | 106 | Good |
| 4 | 4.0 | 0 | 0.240 | 0.096 | 2,900 | 113 | Good |
| 5 | 4.0 | 0 | 0.270 | 0.108 | 2,900 | 113 | Good |
| 6 | 5.0 | 0.618 | 0.109 | 0.044 | 2,200 | 86 | Collapsed |
| 7 | 5.0 | 0.618 | 0.150 | 0.060 | 2,200 | 86 | Collapsed |
| 8 | 5.0 | 0.618 | 0.203 | 0.081 | 2,900 | 113 | Good |
| 9 | 5.0 | 0.618 | 0.240 | 0.096 | 2,900 | 113 | Good |
| 10 | 5.0 | 0.618 | 0.270 | 0.108 | 2,900 | 113 | Good |
| 11 | 5.5 | 0.927 | 0.109 | 0.044 | 1,900 | 74 | Collapsed |
| 12 | 5.5 | 0.927 | 0.150 | 0.060 | 2,400 | 94 | Collapsed |
| 13 | 5.5 | 0.927 | 0.203 | 0.081 | 2,900 | 113 | Good |
| 14 | 5.5 | 0.927 | 0.240 | 0.096 | 2,900 | 113 | Good |
| 15 | 5.5 | 0.927 | 0.270 | 0.108 | 2,900 | 113 | Good |
| 16 | 6.0 | 1.236 | 0.109 | 0.044 | 2,100 | 82 | Collapsed |
| 17 | 6.0 | 1.236 | 0.150 | 0.060 | 2,900 | 113 | Collapsed |
| 18 | 6.0 | 1.236 | 0.203 | 0.081 | 2,900 | 113 | Good |
| 19 | 6.0 | 1.236 | 0.240 | 0.096 | 2,900 | 113 | Good |
| 20 | 6.0 | 1.236 | 0.270 | 0.108 | 2,900 | 113 | Good |

Since the curvature of each segment 12' remains unchanged as the die is radially expanded, there is a deviation from a true radius contour when the die is expanded. However, the effect on the tube being formed has been found to be negligible.

Figure 2:
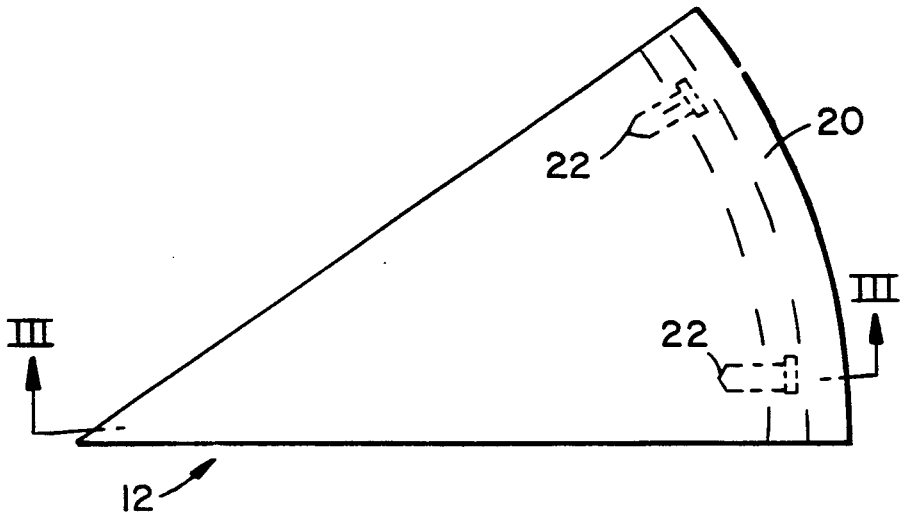
FIG. 2 is a schematic plan view of a typical die sector.
Figure 3:
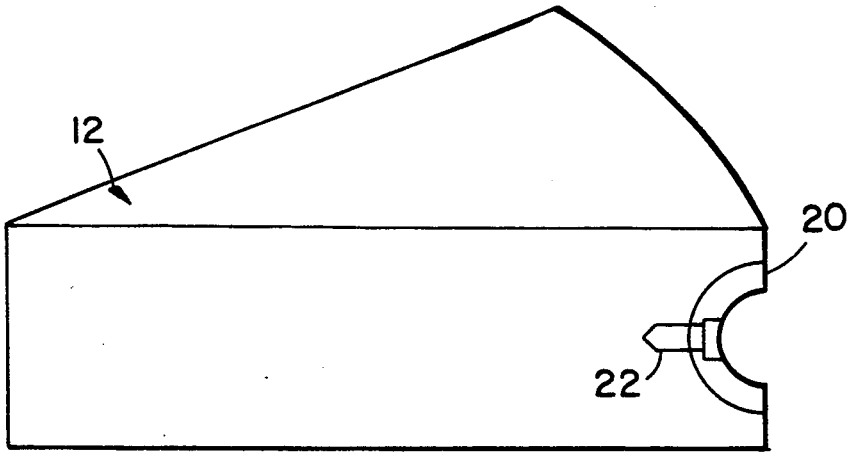
FIG. 3 is an elevational sectional view of FIG. 2 taken along the lines III—III of FIG. 2.

Referring to FIGS. 2 and 3, a further embodiment of the invention comprises the addition of inserts 20 attached to the base of each die segment 12 by fasteners 22. The use of inserts permits various diameter tubes to be formed with the same segmented die 12 for producing a range of tube bending radii.

FIGS. 4 and 5 illustrate the preferred embodiment of how the die segments 12, 12' are expanded and maintained in the retracted and expanded positions. As been seen in FIG. 5, an adjustable ram 24 is clasped with fasteners 26 within the ram support 28. The adjustable ram 24 which is semi-circular has its circular side 30 at an angle $\theta$ in contact with the die segments 12. The die segments 12 have their inner edge 13 beveled to correspond to angle $\theta$ and fit securely against ram 24. Adjustment of fasteners 26 moves the ram 24 within the ram support 28 in the direction indicated by arrow 27. This movement of ram 24 is translated into a radially outward or inward movement of die segments 12 by means of the angular side 30. Movement of the adjustable ram 24 with the mechanical means 26 causes motion of the die segments 12 so that various die radii are defined.

Upper and lower die supports 32, 34 retain the die segments 12 in the correct plane and provide support. The lower die support 34 includes a guide 36 immediately under the die segments 12 to better retain the die segments 12 when there is a force exerted upon them. Also, it assists in guiding the individual die segments 12 during expansion and retraction.

It is envisionable that adjustable ram 24 may be moved hydraulically with a sensor such as a linear variable differential transformer (LVDT) monitoring its position. This arrangement is easily automatically controlled with a microprocessor or a computer (not shown).

Figure 6:
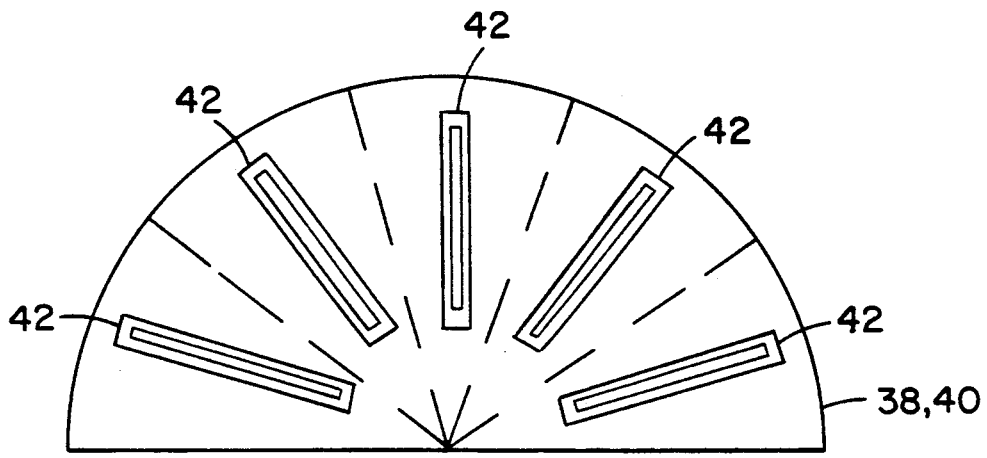
FIG. 6 is a plan view of top and bottom end plates 38, 40 indicating the T-slots 42 therein.
Figure 7:
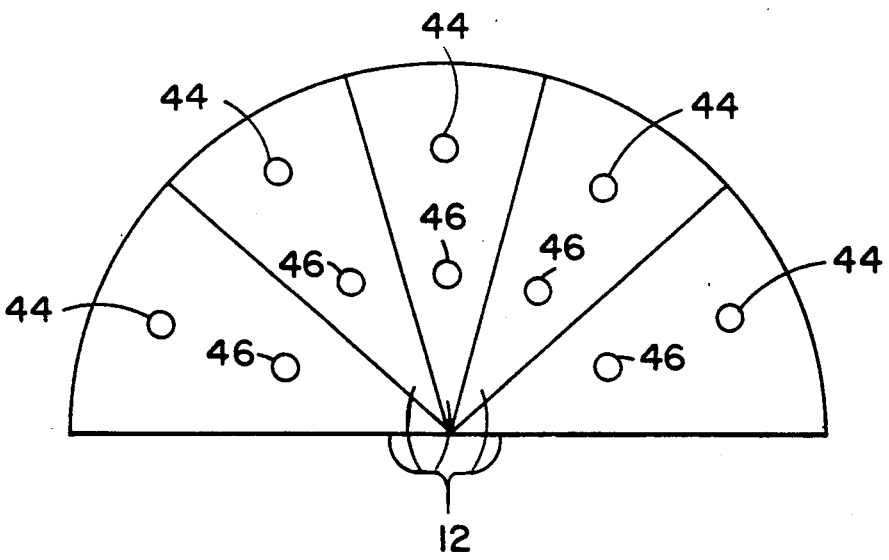
FIG. 7 is a plan view of an alternate embodiment of the segmented dies 12 in the retracted position.

In another embodiment of the present invention, the die segments 12 are situated between a top and bottom end-plate 38, 40 respectively. The end-plates 38, 40 are semi-circular to conform with the die segments 12 in the retracted position as is depicted in FIG. 6. The end plates 38, 40 have T-slots 42 situated so that a T-slot 42 is provided for each die segment 12.

Figure 8:
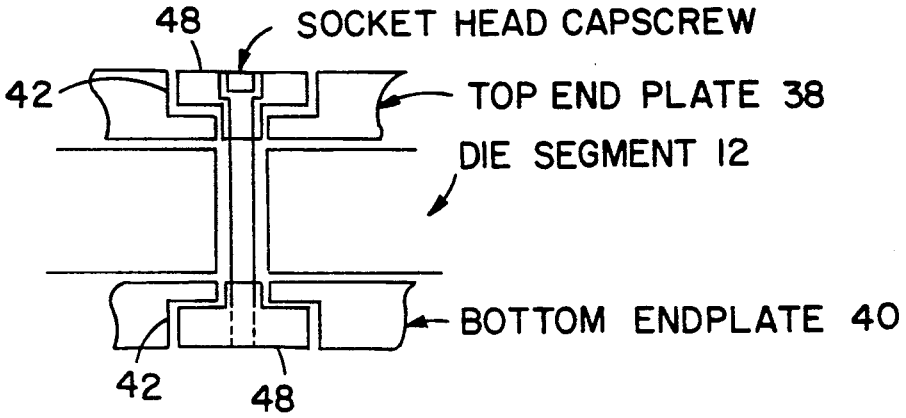
FIG. 8 is a partial sectional view depicting the top and bottom end plates 38, 40 clamping the die segment 12 therebetween.

In the embodiments illustrated in FIGS. 6–9, each die segment 12 has at least two holes 44, 46. The slots 42 in the upper and lower end plates 38, 40 are in alignment with the holes 44, 46 for each die segment 12. The holes 44, 46 are positioned in each die segment 12 to define, respectively, the retracted and expanded positions. For example, in the retracted position, hole 44 in each segment 12 is secured in slot 42 with a fastener 48 as best seen in FIG. 8. Similarly, when hole 44 can no longer be secured in slot 42, but hole 46 is capable of being secured to the outermost part of slot 42 then an expanded position is defined. From the foregoing it is immediately apparent that a plurality of holes in each die segment 12 defines various die radii. At least one of the holes must be within the radius of the end plate in the fully extended position to clamp. Alternatively, various die radii can still be achieved by securing hole 46 at any point along slot 42 for each die segment 12.

For the purpose of maintaining the die segment 12 in the desired position, the fastener 48 should fit snugly in T-slot 42 and a socket head cap screw 48 is preferred.

In this fashion, each of the die segments 12 are clamped between the top and bottom end plates 38, 40. The radial T-slots 42 in conjunction with fasteners 48 and holes 44, 46 allow for radial adjustment of the die segments 12 from a retracted position to an expanded position.

Figure 9:
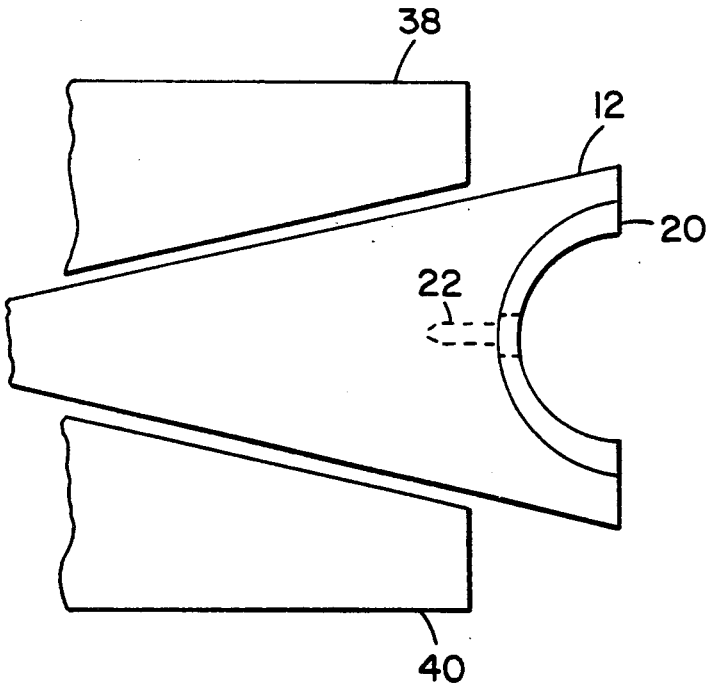
FIG. 9 is a partial sectional view of another embodiment of the segmented dies 12 and top and bottom end plates 38, 40.

A further embodiment includes tapering the end plates 38, 40 radially outward as shown in FIG. 9 to assist in resisting radial bending loads without slippage. Each die segment 12 is tapered down towards center to match the end plates 38, 40.

The segmented die 10 of the present invention provides advantages over the prior art in that it permits the more frequent use of die-press bending equipment with consequent savings in material and labor over the rotary draw method. Moreover, the present invention requires a much smaller ram die inventory to produce a large range of bend geometries since the dies are continuously or incrementally adjustable over a wide range of bend radii. Further, they are easily modified with the addition of inserts to adapt to various sized diameter tubing.

FIG. 10 depicts a general schematic arrangement of how the present invention is employed in a die-press bender 50. A pipe or tube 52 is inserted between the adjustable formers 54 situated on the die press back stop 56 and the variable geometry die 10 with its corresponding tube supports 58 connected to a die press ram 60. A ram force is exerted on the die press ram 60 as indicated by arrow 62 to effect bending of tube 52 with the variable geometry die 10 of the present invention.

All of the materials of the die press bender 50 and variable geometry die 10 are hardened steel, well known in this art to accomplish the above described bending method.

While in accordance with the provisions in the statutes, there is illustrated and described herein specific embodiments of the invention, those skilled in the art will understand that changes may be made in the form of the invention covered by the claims, and certain features of the invention may sometimes be used to advantage without a corresponding use of the other features.

An example of one such change is to make the radial extensions of the segments 12 unequal to provide for non-circular bending.

We claim:

1. A variable geometry die for a die-press bender for bending a material, comprising:

a ram support;

an adjustable ram, said adjustable ram being beveled and positioned in said ram support by at least one fastener for providing movement to said adjustable ram; and a plurality of die segments movably situated on said adjustable ram in an orientation adapted to receive the material for bending, each of said die segments being substantially triangular with an apex and a base having a curvature defining a radius, the apex of each of said die segments being beveled to correspond to the bevel on said adjustable ram for translating the movement of said adjustable ram into radial movement of said die segments for defining various die radii.

2. A variable geometry die, as recited in claim 1, wherein the base of each die segment includes an interchangeable insert.

3. A variable geometry die, as recited in claim 1, further comprising upper and lower die supports for retaining and supporting said die segments.

4. A variable geometry die, as recited in claim 3, further comprising a guide positioned immediately under said die segments for guiding said die segments during radial movement.

5. A variable geometry die, as recited in claim 1, wherein the radial movement of said die segments produces a separation between one die segment with another defined as follows:

$$G=2D \sin (180/2N)$$

wherein:

G = separation distance in inches

D = radial expansion of all die segments in inches

N = number of segments in 180°

6. A variable geometry die for a die press bender for bending a material, comprising:

a plurality of die segments movably situated in an orientation adapted to receive the material for bending, each of said die segments being substantially triangular with a base having a curvature defining a radius, each of said die segments having at least two holes radially aligned;

top and bottom end-plates in a coextensive orientation with said die segments situated therebetween, said top and bottom end-plates having a plurality of radially extending slots with each of said slots being in radial alignment with the holes in each die segment, said end-plates being radially tapered outward with each of said die segments tapering inward; and at least one fastener for each die segment passing through said slot and at least one hole of said die segment for securing said die segments between said top and bottom end-plates to provide various die radii and to resist radial bending loads.

7. A variable geometry die, as recited in claim 6, wherein the base of each die segment includes an interchangeable insert.

8. A variable geometry die, as recited in claim 6, wherein said radially extending slots are T-slots.

9. A variable geometry die, as recited in claim 6, wherein the radial movement of said die segments produces a separation between one die segment with another defined as follows:

$$G=2D \sin (180/2N)$$

wherein:

G = separation distance in inches

D = radial expansion of all die segments in inches

N = number of segments in 180°.

* * * * *